US005222431A

United States Patent [19]

Kawahara

[11] Patent Number: 5,222,431

[45] Date of Patent: Jun. 29, 1993

[54] ELECTRICAL STAMP DEVICE CAPABLE OF DISPLAYING AN IMAGE LAYOUT, AND WHICH USES A STENCIL PAPER

[75] Inventor: Hiroshi Kawahara, Nishikasugai, Japan

[73] Assignee: Brother Kogyo Kabushiki Kaisha, Nagoya, Japan

[21] Appl. No.: 864,340

[22] Filed: Apr. 6, 1992

[30] Foreign Application Priority Data

May 23, 1991 [JP] Japan ..... 3-36756[U]

[51] Int. Cl.[5] ..... B05C 17/06

[52] U.S. Cl. .....101/128.21; 400/83; 400/136; 101/333

[58] Field of Search ..... 101/128.21, 128.4, 125, 101/121, 122, 327, 333; 400/83, 88, 136

[56] References Cited

U.S. PATENT DOCUMENTS 2,499,472 3/1950 Dyal ..... 101/121
3,799,053 3/1974 Rabelow ..... 101/125
4,957,378 9/1990 Shima ..... 400/136 X
5,002,410 3/1991 Yajima ..... 400/88

FOREIGN PATENT DOCUMENTS 63-11855 1/1988 Japan .
63-17074 1/1988 Japan .

*Primary Examiner*—Edgar S. Burr
*Assistant Examiner*—Ren Yan
*Attorney, Agent, or Firm*—Oliff & Berridge

[57] ABSTRACT

A stamp device employs a heat sensitive stencil paper which includes a thermoplastic film and a porous carrier. The heat sensitive stencil paper is perforated by a thermal head according to characters, symbols, figures, etc. of an image input from an input mechanism. The display can be controlled to display a layout of the image to be perforated on the heat sensitive stencil paper. Therefore, a user can determine whether the layout is acceptable prior to perforating the stencil sheet. Consequently, the user can accurately print at a desired position on a recording medium by confirming the layout on the display prior to printing.

20 Claims, 9 Drawing Sheets

ELECTRICAL STAMP DEVICE CAPABLE OF DISPLAYING AN IMAGE LAYOUT, AND WHICH USES A STENCIL PAPER

CROSS-REFERENCE TO RELATED APPLICATIONS

This application is related to U.S. Pat. Application Ser. No. Docket 07/864,349, to Toshihide Fujikawa et al., entitled "Electrical Stamp Device Which Compensates For Ink Temperature And Which Uses A Stencil Paper", filed concurrently herewith. This application is also related to U.S. Pat. Application Ser. No. 07/811,974 entitled "Stamp Device Employing A Heat Sensitive Stencil Paper To Be Perforated By Heat Of A Thermal Head" to Takashi Miki et al., filed Dec. 23, 1991; and U.S. Pat. Application Ser. No. 07/812,107 entitled "Stamp Device Employing An Elongate Heat Sensitive Stencil Paper" to Teruo Imamaki et al., filed Dec. 23, 1991. The disclosures of U.S. Pat. Application Nos. 07/811,974 and 07/812,107 are incorporated herein by reference.

BACKGROUND OF THE INVENTION

1. Field of the Invention

The present invention relates to hole impression printing devices, and more particularly to stamp devices employing a heat sensitive stencil paper which can print images by receiving pressure which causes ink to flow through holes which form a stencil pattern in the stencil paper.

2. Description of Related Art

A compact portable stamp device which employs stencil paper having a perforated pattern of characters, figures, etc. formed by using a pencil or a ball-point pen is known. For example, FIG. 8 shows a stamp device disclosed in U.S. Pat. No. 3,799,053. The construction of the stamp device will be explained with reference to FIG. 8.

The stamp device includes a table 100, a bottle grip 101, an inking unit 102, a compression spring 103 and a syphon tube 105. The bottle grip 101 is flexible and is used like a squeeze bottle. That is, the inside of bottle grip 101 is hollow with liquid ink stored therein.

Compression spring 103 is disposed between bottle grip 101 and table 100. Compression spring 103 presses bottle grip 101 and table 100 so as to part them from each other. Therefore, inking unit 102 connected to bottle grip 101 is usually arranged within the confines of table 100. Therefore, even if table 100 is placed on a medium to be printed, such as ordinary plain paper, the medium does not receive a printing image.

Table 100 is made from a metal plate, such as aluminum so as to be easily cleaned. The four sides of the metal plate are bent downwardly so that the lower side of table 100 is open. An aperture is formed at the center of the upper side of table 100. Bottle grip 101 and the inking unit 102 are connected to each other through the aperture.

An ink pad is disposed inside of inking unit 102, such that the liquid ink stored in bottle grip 101 will be supplied to the ink pad. A stencil paper 104 having a perforation pattern of characters, figures, etc. formed by using a pencil, a ball-point pen or other pointed instruments is detachably arranged under the ink pad.

Syphon tube 105 is provided in bottle grip 101 and supplies the ink stored in bottle grip 101 to the ink pad of inking unit 102.

Next, the operation of the stamp device will be explained with reference to FIG. 8. In the stamp device, a user draws characters, figures, etc. on stencil paper 104 by using a pencil or a ball-point pen. Stencil paper 104 is then perforated based on the drawn pattern. Next, the user installs stencil paper 104 under inking unit 102 and places the stamp device on a medium to be printed, such as an ordinary paper. The user grasps bottle grip 101 and pushes it downward. This causes inking unit 102 to descend against the bias of compression spring 103, so that inking unit 102 is pressed against the ordinary paper through stencil paper 104. Ink from the ink pad of inking unit 102 then passes through the perforations of stencil paper 104 so that the ordinary paper is printed with the ink in the pattern formed on stencil paper 104. If the user stops pressing down on bottle grip 101, the stamp device returns to the former state by expansion of compression spring 103 so that inking unit 102 parts from the ordinary paper, completing the printing operation.

If after a plurality of print operations, the ink of the ink pad is depleted, the user firmly grips and squeezes flexible bottle grip 101. This causes the ink in bottle grip 101 to pass through syphon tube 105 and be supplied to the ink pad of inking unit 102.

In the stamp device described above, the printing operation is executed after a stencil paper having a perforation pattern of characters, figures, etc. drawn by using a pencil or a ball-point pen is placed under inking unit 102. Therefore, it is difficult for a user to confirm the position of the perforation pattern contained on the stencil paper relative to table 100. Consequently, there is a problem in that it is difficult for the user to accurately print at a desired position on the medium to be printed.

OBJECT AND SUMMARY OF THE INVENTION

It is therefore an object of the present invention to provide a stamp device which can accurately print at a desired position on a medium to be printed.

To achieve the foregoing and other objects, and to overcome the shortcomings discussed above, the stamp device of the present invention comprises: a stencil paper; display means for displaying characters, figures, etc., of the image to be perforated in the stencil paper; perforating means for forming a perforation pattern of the image in the stencil paper; and control means for controlling the display means so that the display means displays the layout for the image to be perforated in the stencil paper by the perforation means. Preferably, the stencil paper is a heat sensitive stencil paper, and the perforating means is a thermal head.

According to the stamp device of the present invention, the control means controls the display means so that the display means displays the layout for the image to be perforated in the heat sensitive stencil paper by the perforation means. Because the layout of the image to be perforated on the heat sensitive stencil paper is displayed on the display, the user can print at the desired position on the print medium by confirming the layout.

BRIEF DESCRIPTION OF THE DRAWINGS

Preferred embodiments of the present invention will be described in detail with reference to the following figures in which like reference numerals refer to similar elements, and wherein.

DETAILED DESCRIPTION OF THE PREFERRED EMBODIMENTS

Preferred embodiments of the present invention will now be described with reference to the drawings.

Figure 1:
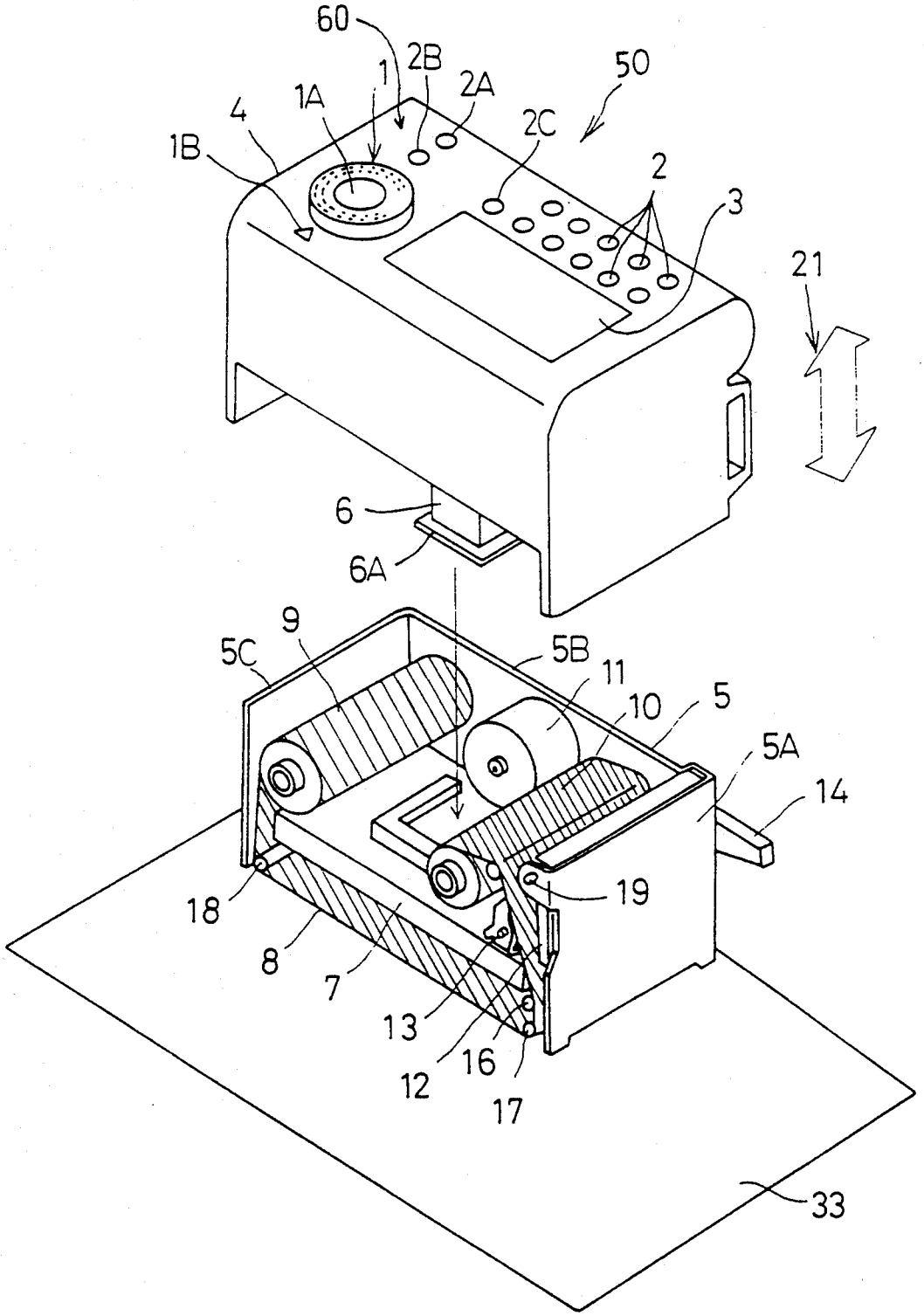
FIG. 1 is a perspective view of a stamp device according to a first embodiment of the present invention.

First, the construction of a stamp device 50 according to a first embodiment of the invention will be explained with reference to FIG. 1. The description of the stamp device 50 is provided with respect to the device exterior portion and the device interior portion, both shown in FIG. 1. First, the exterior portion of stamp device 50 will be explained.

The exterior of stamp device 50 generally comprises a housing 4 and a chassis 5.

Housing 4 is made from, for example, a material such as resin. Housing 4 is a hexahedron having an open bottom side so as to receive chassis 5. Housing 4 and chassis 5 are assembled together by any well-known method. Housing 4 can move relative to chassis 5 in the vertical direction, and can move integrally with chassis 5 in the horizontal direction. An input portion 60 which functions as an input means and a display 3 which functions as a display means are provided on housing 4. An ink pad holder 6 for holding an ink pad 7 (to be described later) is integrally provided inside housing 4. Ink pad holder 6 is, for example, a square pole. A projection 6A for attachment to ink pad 7 is formed on the tip of the ink pad holder 6.

Chassis 5 is made from, for example, metal such as aluminum, and is more or less "C" shaped so that upper side, lower side and front side are open. That is, chassis 5 includes three side walls 5A, 5B and 5C. Chassis 5 holds each internal element of the stamp device interior, as will be described later. A release lever 14 is provided pivotally on the outer surface of chassis 5. Release lever 14 is used for moving a thermal head 12 and a platen 13 between a release position, where thermal head 12 and platen 13 are spaced apart from each other, and an engaged position, where thermal head 12 and platen 13 are engaged with each other with a heat sensitive stencil paper 8 (hereafter referred to as a stencil paper) located therebetween. Release lever 14 is moved to the release position when it is necessary to exchange the stencil paper 8 for a fresh roll.

Input portion 60 is comprised of a dial 1 for selecting characters, symbols, figures etc. of the image to be input, a button 1A and various keys 2. Additionally, on the upper side of the device exterior portion, a power switch 2A, a perforation starting key 2B and a layout confirmation key 2C are provided.

The dial 1 is provided rotatably. The hiragana, the letters of the English alphabet, figures, and symbols are printed on dial 1. During use, one of the characters, figures and symbols confronting with a triangular mark 1B can be selected to be input to a RAM 76 (to be described later).

Button 1A is provided at the center of dial 1. When a user pushes button 1A, one of the characters, figures and symbols which is selected by the dial I is defined, and stored in RAM 76.

The various keys 2 are function keys such as a conversion key, a shift key, a cursor move key, etc. The conversion key is used for converting a hiragana character selected by the dial 1 and stored in the RAM 76, into a corresponding chinese character. The shift key is used for selecting whether the selected character is printed as a capital or a lower case letter. The cursor move key is used for moving a cursor on display 3. Other function keys can also be provided for changing the layout or the format of the image on display 3, and of the image to be printed. Power switch 2A is used for turning stamp device 50 on or off.

The perforation starting key 2B is used for starting a perforation operation of stencil paper 8 according to the image input into RAM 76.

The layout confirmation key 2C is used for changing a display mode of display 3 of stamp device 50 into an image input mode or a layout confirmation mode. Stamp device 50 is switched between image input mode and the layout confirmation mode whenever the user pushes layout confirmation key 2C. The image input mode can display directly the image (e.g., characters, figures, symbols) being stored into the RAM 76 when the user inputs desired images into RAM 76 with input portion 60. The layout confirmation mode can display the layout for the perforation patterns of the entire image to be formed in stencil paper 8. The perforation patterns are formed according to the entered and (possibly) edited image stored in RAM 76.

Display 3 is disposed adjacent to the dial 1 and the various keys 2. Display 3 displays the characters, figures, symbols, etc. stored in the RAM 76, and further can display a format information or a message. Display 3 is, for example, a liquid crystal display or a plasma display. In addition, the shape of display 3 corresponds (is substantially identical) to the base of stamp device 50 (although the size may not be one-to-one with the size of the base of stamp device 50). Therefore, when the display mode of display 3 is set in the layout confirmation mode, the user can confirm the position where the entire image displayed on display 3 and stored in RAM 76 will be printed. In the present embodiment, the resolution of the image to be printed on printing paper 33 is about 100–300 dots/inch, and the resolution of display 3 is about 80 dots/inch. Therefore, to display the print area of stencil paper 8 onto display 3, each character, symbol, etc. of the image is contracted so as to be displayed in the more limited number of dots of display 3 when in the layout confirmation mode. This permits display 3 to display the entire printing area of stencil paper 8. In this example, the user may not be able to confirm the contents of, for example, each sentence of the image on display 3; however, the user can confirm the arrangement of the image to be printed on the printing area of printing paper 33 by viewing display 3.

Next, the interior portion of stamp device 50 will be explained. The interior of stamp device 50 includes ink pad holder 6, ink pad 7, a take-up roll 9, a supply roll 10, a stepping motor 11, thermal head 12 for forming an image, platen 13 and guide rolls 16, 17 and 18.

Figure 1A:
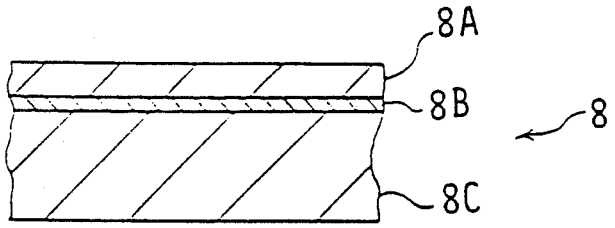
FIG. 1A is a cross-sectional view of a heat sensitive stencil paper for use with preferred embodiments of the present invention.

Stamp device 50 employs stencil paper 8. The stencil paper 8 is comprised of a thermoplastic film 8A, an adhesive layer 8B and a porous carrier 8C, as shown in FIG. 1A, wherein the thermoplastic film 8A and the porous carrier 8C are bonded to each other through the adhesive layer 8B. In a preferred embodiment, the thermoplastic film is a polyethylene terephthalate film (hereinafter referred to as a "PET film") having a thickness of 2 μm. However, the film may be polypropylene, a vinylidene chloride-vinyl chloride copolymer or the like.

The thickness of the PET film is preferably 1–4 μm. If the thickness is less than 1 μm, a manufacturing cost becomes high, and a strength becomes low. In contrast, if the thickness is more than 4 μm, it becomes difficult to perforate the film with common thermal heads having a rated power of about 1 mJ/dot.

Porous carrier 8C in this preferred embodiment is formed of porous thin paper made of mainly natural fiber such as Manila hemp, kozo and mitzumata, synthetic fiber such as PET, polyvinyl alcohol, polyacrylonitrile and polypropylene, or semisynthetic fiber such as rayon. Porous carrier 8C is mainly used for supplementing the strength of perforated thermoplastic film 8A. Therefore, the thickness of porous carrier 8C is preferably 40 μm–60 μm, in the present embodiment, 50 μm. Initially, the web-like stencil paper 8 is wound up on supply roll 10. Stencil paper 8 wound up on supply roll 10 is fed over the platen 13 and guide rolls 16, 17, under ink pad 7, and is received and wound on take-up roll 9 via guide roll 18.

Ink pad 7 functions as an ink storing means, and is formed, for example, to have a hexahedron shape. The lower side of the ink pad is open. The ink pad 7 includes an outer body made from a metal which does not corrode, such as stainless, or resins, such as vinyl chloride, polypropylene, polyethylene, polyacetal and polyethylene terephthalate. An ink storing layer which holds the ink is located inside the body of ink pad 7. The ink pad 7 is provided so as to be detachable from projection 6A of ink pad holder 6. Ink pad 7 can be removed from chassis 5 by sliding pad 7 through the open front portion of chassis 5. When the user presses down on housing 4, housing 4 and ink pad 7 move integrally against chassis 5 in the vertical direction indicated by arrow 21 in FIG. 1.

The ends of supply roll 10 and the take-up roll 9 are supported rotatably by chassis 5, respectively.

Stepping motor 11 is disposed so as to be fixed to chassis 5, and drives the roller of platen 13 so that a roller of platen 13 rotates. Additionally, stepping motor 11 drives a well-known drive force transmitting device (not shown). The drive force transmitting device comprises a rotation drive portion which receives a drive power from stepping motor 11, and a slip clutch for transmitting the rotation of the rotation drive portion through friction torque to take-up roll 9. The perforated stencil paper 8 is wound up by the take-up roll 9 which is energized to rotate in the clockwise direction as shown in FIG. 1. The speed at which the stencil paper 8 is fed is controlled by the roller of platen 13. When the clutch does not slip, the drive force transmitting device having the above-mentioned construction is set such that the peripheral velocity of take-up roll 9 is usually more than the peripheral velocity of the roller of platen 13. However, the frictional torque of the slip clutch, that is, the tangential power applied by take-up roll 9 is less than the frictional force between stencil paper 8 and platen 13. Therefore, the clutch slips in the range between the maximum peripheral velocity of take-up roll 9 and the peripheral velocity of the roller of platen 13. Thus, stencil paper 8 is maintained tightly between platen 13 and take-up roll 9.

Thermal head 12 used for the perforated image forming operation on stencil paper 8 is similar to that used in conventional heat transcript printers. The thermal head 12 includes a shaft 19 which is pivotally supported by chassis 5. By pivoting about shaft 19 (shaft 19 is linked to release lever 14), thermal head 12 can be moved away from or close to platen 13 as described above. By selectively supplying current to the thermal head 12, individual heating elements of thermal head 12 generate heat so that the thermoplastic film 8A of stencil paper 8 is selectively perforated.

Platen 13 includes a roller which has a cylindrical shape and has a somewhat flexible surface, such as silicon rubber. By rotating the cylindrical roller of platen 13, stencil paper 8 is unwound from supply roll 10, and is fed along a portion of the surface of the cylindrical roller of platen 13. The cylindrical roller of platen 13 is also supported rotatably by chassis 5. For further details of the cylindrical of platen 13, see U.S. Pat. Application No. 07/864,349,the disclosure of which is incorporated herein by reference.

Each hollow guide roll 16, 17 and 18 is also cylindrical, and is made from resins such as polypropylene, polyacetal and polyethylene. Because guide rolls 16, 17 and 18 are supported rotatably by chassis 5 so as to come in contact with stencil paper 8, guide rolls 16, 17 and 18 guide the stencil paper 8 through stamp device 50.

Figure 2:
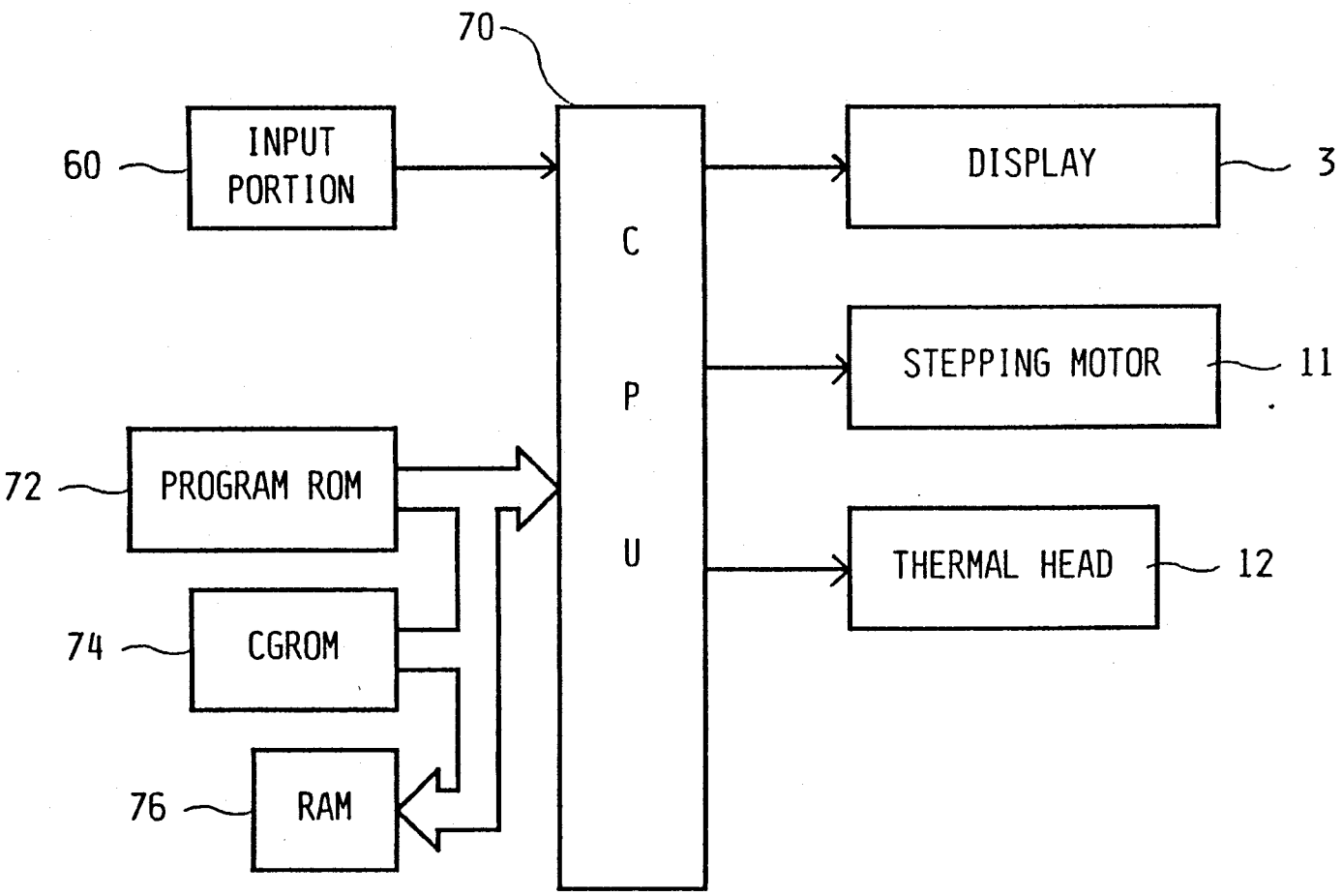
FIG. 2 is a block diagram of the electrical elements of the stamp device of the first embodiment of the present invention.

Next, the construction of a control portion of stamp device 50 will be explained with reference to FIG. 1 and FIG. 2. FIG. 2 is a block diagram showing the electrical elements of the stamp device of the described embodiment. The block diagram of stamp device 50 comprises a CPU (Central Processing Unit) 70 which functions as a control means, input portion 60, a program ROM (Read Only Memory) 72 which functions as a second memory means, display 3, stepping motor 11 which functions as a driving means, thermal head 12 which functions as a perforating means, a CG (Character Generator) ROM 74 which functions as a third storing means, and a RAM (Random Access Memory) 76 which functions as a first storing means.

Program ROM 72 stores an operating program for conducting the operation of stamp device 50 including a program for performing the layout confirmation mode.

CPU 70 reads and executes the operating program for stamp device 50 stored in ROM 72. When the user pushes the layout confirmation key 2C, CPU 70 reads the program for performing the layout confirmation mode from program ROM 72 and displays the edited characters, figures, symbols, etc. of the image stored in RAM 76 on display 3. When in the layout confirmation mode, the content of display 3 is referred to as the layout display.

CG ROM 74 stores character generator patterns which are used for displaying images on display 3 and for perforating images on stencil paper 8.

RAM 76 stores the data input from input portion 60, and edits the data to be displayed and to be used in perforation of stencil paper 8.

Figure 3A:
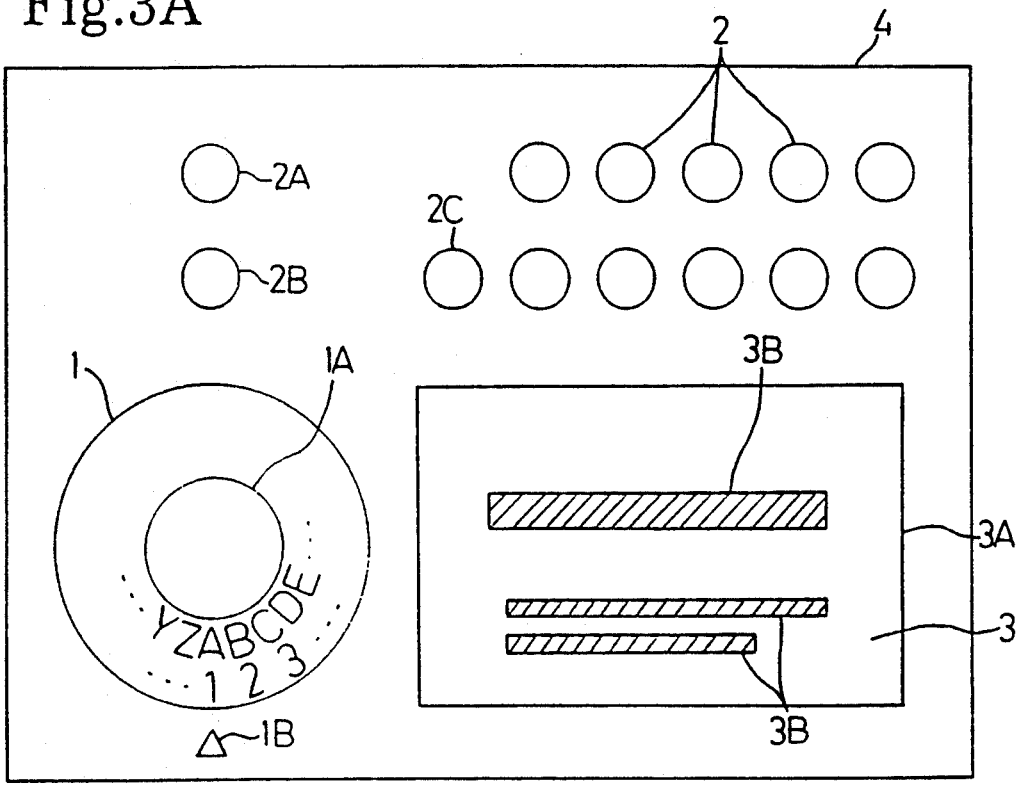
FIG. 3A is a top view of the stamp device of the first embodiment of the present invention.
Figure 3B:
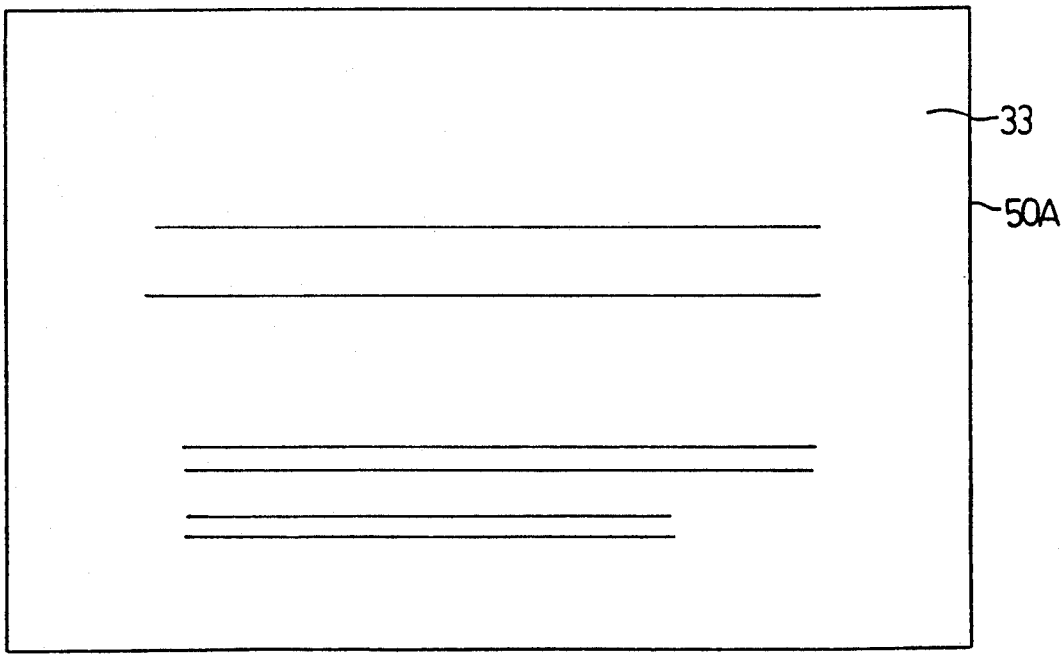
FIG. 3B shows one example of a print image printed by the stamp device of the first embodiment of the present invention.
Figure 4:
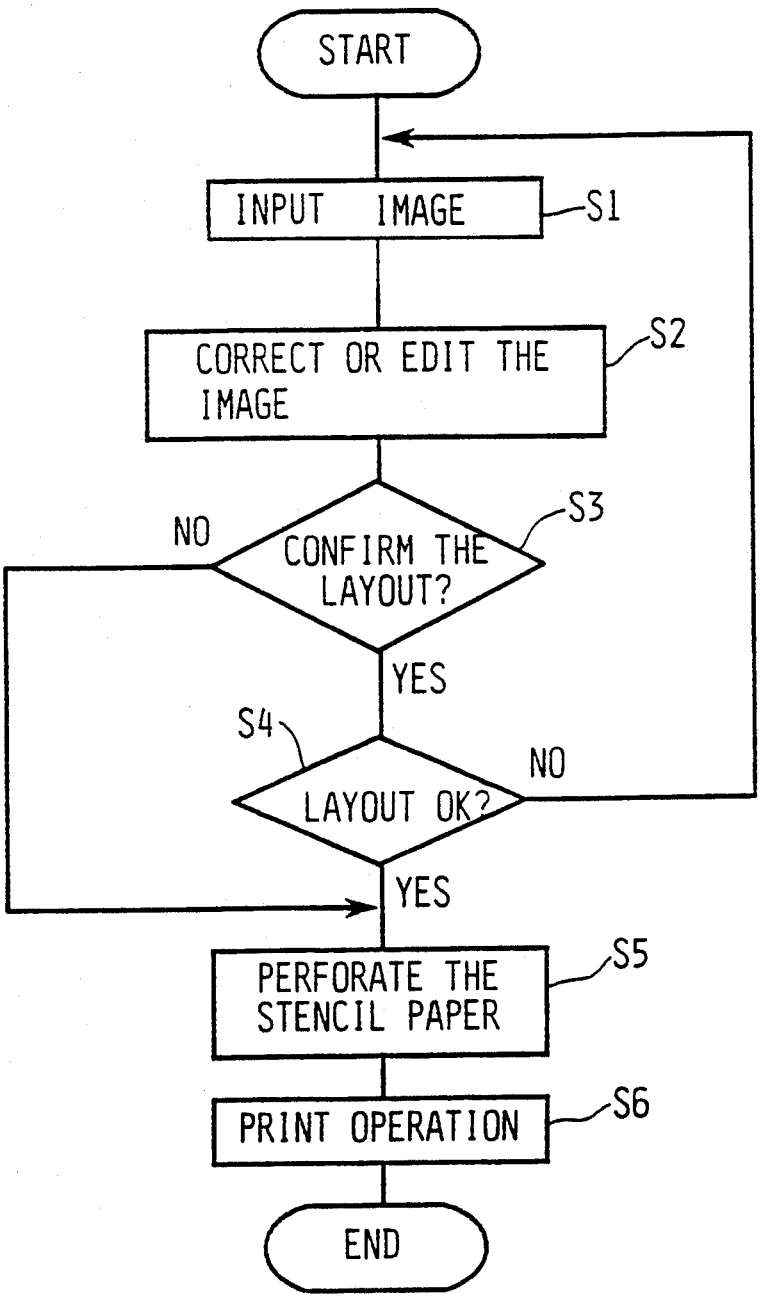
FIG. 4 is a flowchart showing the operation of the stamp device of the first embodiment of the present invention.

Next, the operation of stamp device 50 of the first embodiment of the invention will be explained with reference to FIG. 1 through FIG. 4. The user pushes power switch 2A of stamp device 50 so that power is supplied to stamp device 50. Initially, the display mode of display 3 is set to the image input mode. Next, the user inputs characters, symbols, figures, etc. of the image to be printed by using the input portion 60. The CPU stores the image input with input portion 60 into RAM 76 in Step 1. (Hereafter all steps are referred to with the prefix "S".) The user corrects or edits the input image by using various keys 2 on input portion 60. CPU 70 stores the corrected or edited image into RAM 76 in S2. The user determines whether the layout of the image to be perforated on stencil paper 8 is acceptable in S3 and S4. If the user would like to confirm the layout for the image to be perforated on stencil paper 8, the user pushes layout confirmation key 2C (S3: Yes). Then, CPU 70 reads the program for the layout confirmation mode from program ROM 72. Next, CPU 70 changes the display mode of display 3 into the layout confirmation mode and reads the image from RAM 76. As shown in FIG. 3A, CPU 70 displays the image on display 3 by shading portions 3B of display 3 corresponding to the image to be printed. A frame 3A of display 3 has a similar shape as the base of stamp device 50. In the illustrated example, frame 3A is one-half as large as the base of stamp device 50. Therefore, as described later, when the user places stamp device 50 on the medium to be printed in order to execute the print operation, the user can refer to the shaded portions of display 3 to determine whether the format of the image is acceptable, because frame 3A of display 3 corresponds to the base of stamp device 50. Then, as shown in FIG. 3B, because the frame 3A corresponds to the base of the stamp device 50, the user can accurately print at a desired position on the medium to be printed. FIG. 3B shows an outline 50A of the base of stamp device 50, and further shows the position of the image to be printed on image recording medium 33.

Next, the user determines whether the layout for the image displayed on display 3 is acceptable in S4. If the user is satisfied with the layout, the user pushes the perforation starting key 2B (S4: Yes). If the user is dissatisfied with the layout, the user again pushes the layout confirmation key 2C (S4: No). Then, if the layout confirmation key 2C has been pushed, CPU 70 sets the display mode of display 3 back to the image input mode. The user can then input further characters, figures, etc. of the image using input portion 60. CPU 70 again stores the added characters, etc. of the image into RAM 76 in S1. The user repeats the above-described data entry/editing operations until satisfied with the layout.

When the user pushes the perforation starting key 2B (S4: Yes), CPU 70 reads the image to be perforated out from RAM 76. Next, CPU 70 reads the character generator patterns corresponding to the characters, figures, symbols, etc. of the image which were read from RAM 76 out of CG ROM 74. CPU 70 then controls thermal head 12 so that thermal head 12 selectively perforates the stencil paper 8 according to the character generator patterns (S5). When the perforation operation for stencil paper 8 is completed, the user places stamp device 50 on printing paper 33 while confirming that the shaded portions 3B displayed on display 3 are acceptable. If the display mode of display 3 is not set in the layout confirmation mode, the user can push the layout confirmation key 2C so as to change the display mode into the layout confirmation mode. Because the user places stamp device 50 on printing paper 33 while confirming the layout on display 3, the user can accurately print at a desired position on the medium to be printed. The user presses down the stamp device 50, and because the perforated portion of stencil paper 8 has already been fed under ink pad 7, ink from the ink layer located inside ink pad 7, is impregnated into the porous carrier 8C of stencil paper 8. Subsequently, the ink is transferred onto printing paper 33 through the perforations in the thermoplastic film 8A of the stencil paper (S6). By removing stamp device 50 from printing paper 33, the print operation is completed.

If the user does not desire to confirm the layout in S3, the user merely pushes the perforation starting key 2B without pressing the layout confirmation key 2C (S3: No). Then, CPU 70 executes the above-described perforation operation in S5, and print operation in S6.

Figure 5:
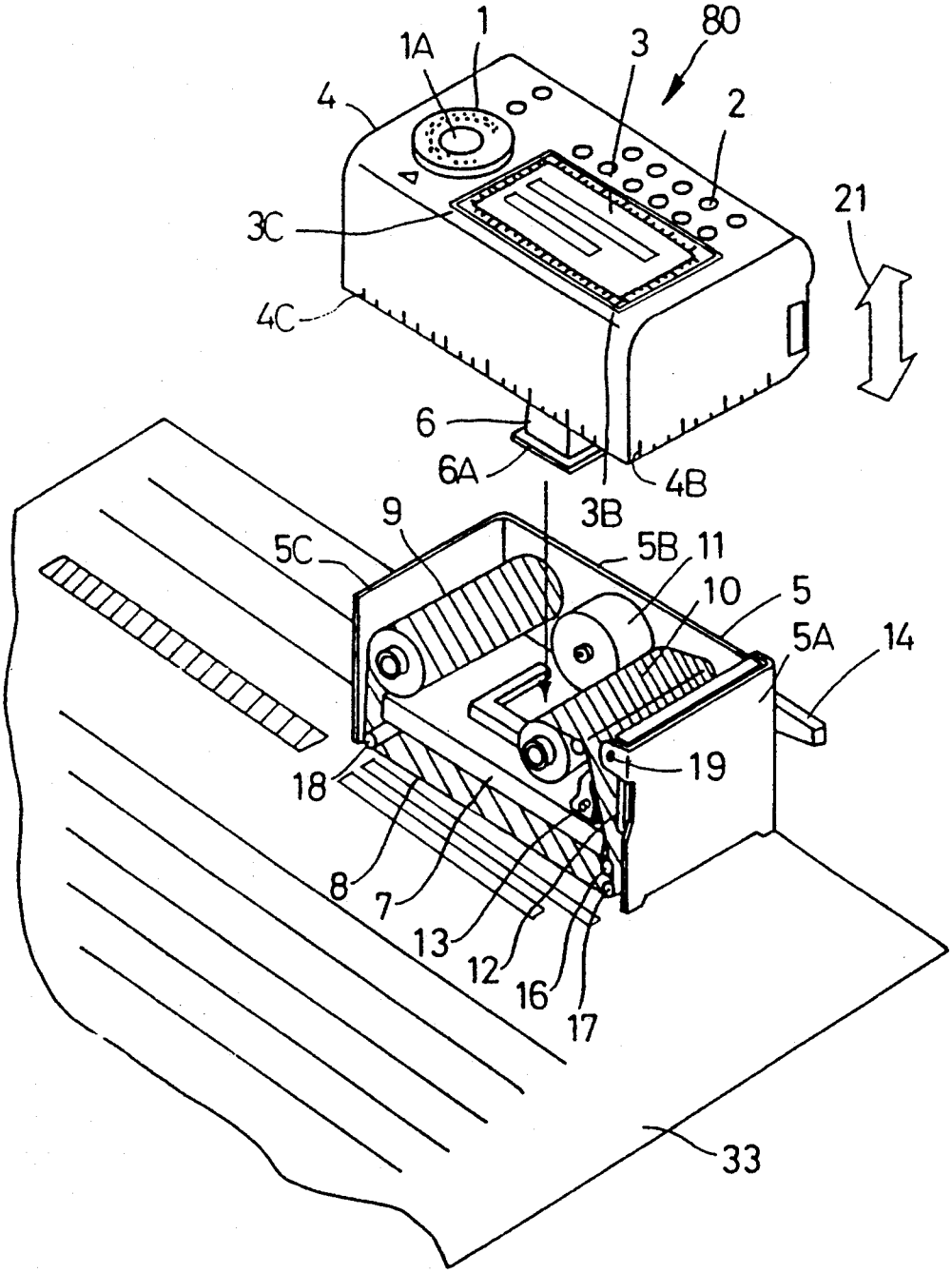
FIG. 5 is a perspective view of a stamp device according to a second embodiment of the present invention.

Next, a stamp device 80 according to a second embodiment of the present invention will be explained with reference to FIG. 5, FIG. 6A and FIG. 6B. Because the construction of the stamp device 80 of the second embodiment is similar to that of stamp device 50 of the first embodiment, only the differences will be described in detail.

Figure 6A:
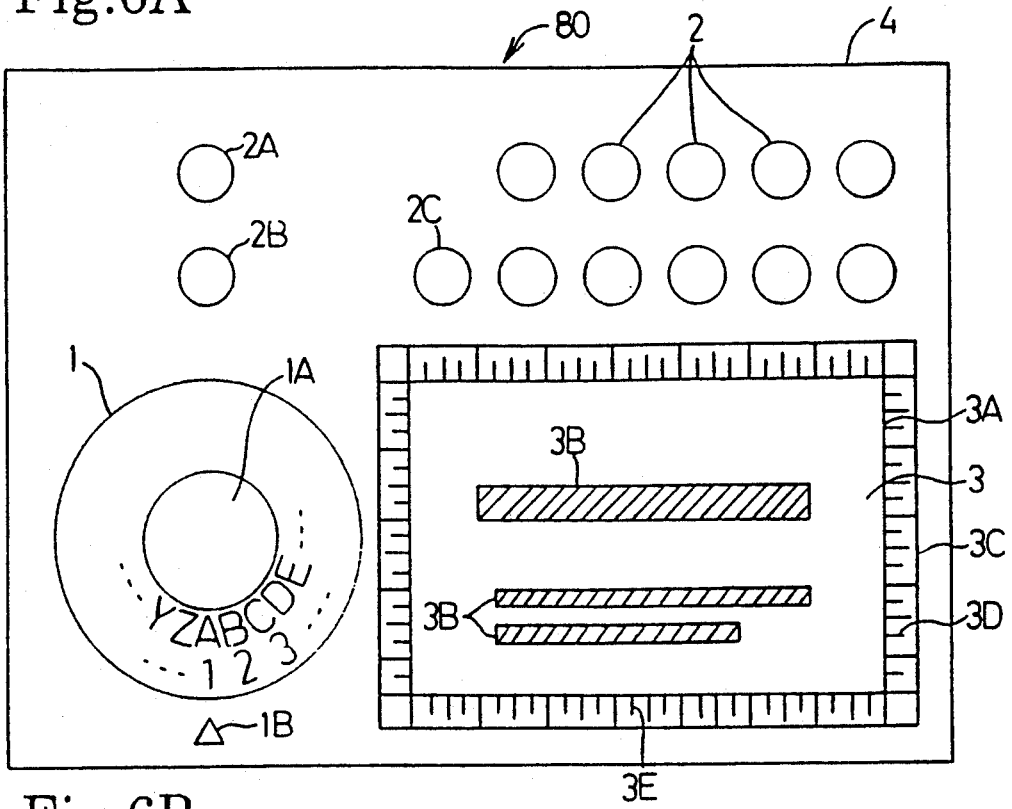
FIG. 6A is a top view of the stamp device of the second embodiment of the present invention.
Figure 6B:
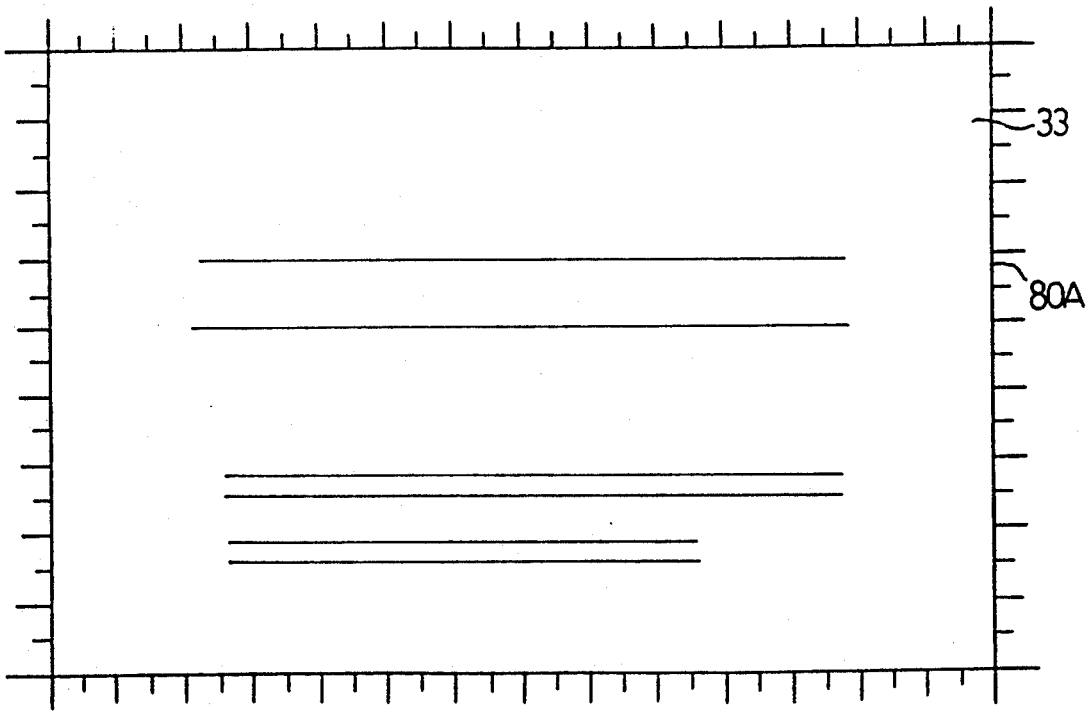
FIG. 6B shows one example of a print image printed by the stamp device of the second embodiment of the present invention.

As shown in FIG. 6A, a graduated frame 3C is provided surrounding display 3 on housing 4 of stamp device 80. The graduated frame 3C is useful for the operator to better visualize the correspondence between display 3 and the base of stamp device 80. Graduations 3D and 3E (first graduations) are formed on adjacent sides of graduated frame 3C. Moreover, a marking 4B corresponding to graduation 3D, and a marking 4C corresponding to graduation 3E, are provided on adjacent sides of the lower portion of housing 4. Indicators 4B and 4C function as second graduations, and have a one-to-one correspondence with graduations 3D and 3E. Optionally, each indicator 4B and 4C can have a one-to-one correspondence with a minimum character or symbol size to be printed on printing paper 33. For example, in FIG. 6B, the second graduations have a one-to-one correspondence with the minimum height of printed characters.

In stamp device 80 having the above-described construction, a shaded portion 3B displayed on display 3 when in the layout confirmation mode corresponds to the printing image position of printing paper 33 where the image is to be printed. As shown in FIG. 6B, when the user executes the print operation, the user places stamp device 80 on printing paper 33 while corresponding graduations 3D and 3E to indicators 4B and 4C. The outline 80A shown in FIG. 6B illustrates the base of stamp device 80. Therefore, as described above, because graduations 3D and 3E on the graduated frame 3C of display 3 of stamp device 80 correspond to indicators 4B and 4C, respectively, the user can print accurately at any desired position. The printing operation with the second embodiment is even more accurate than with the first embodiment.

Figure 7:
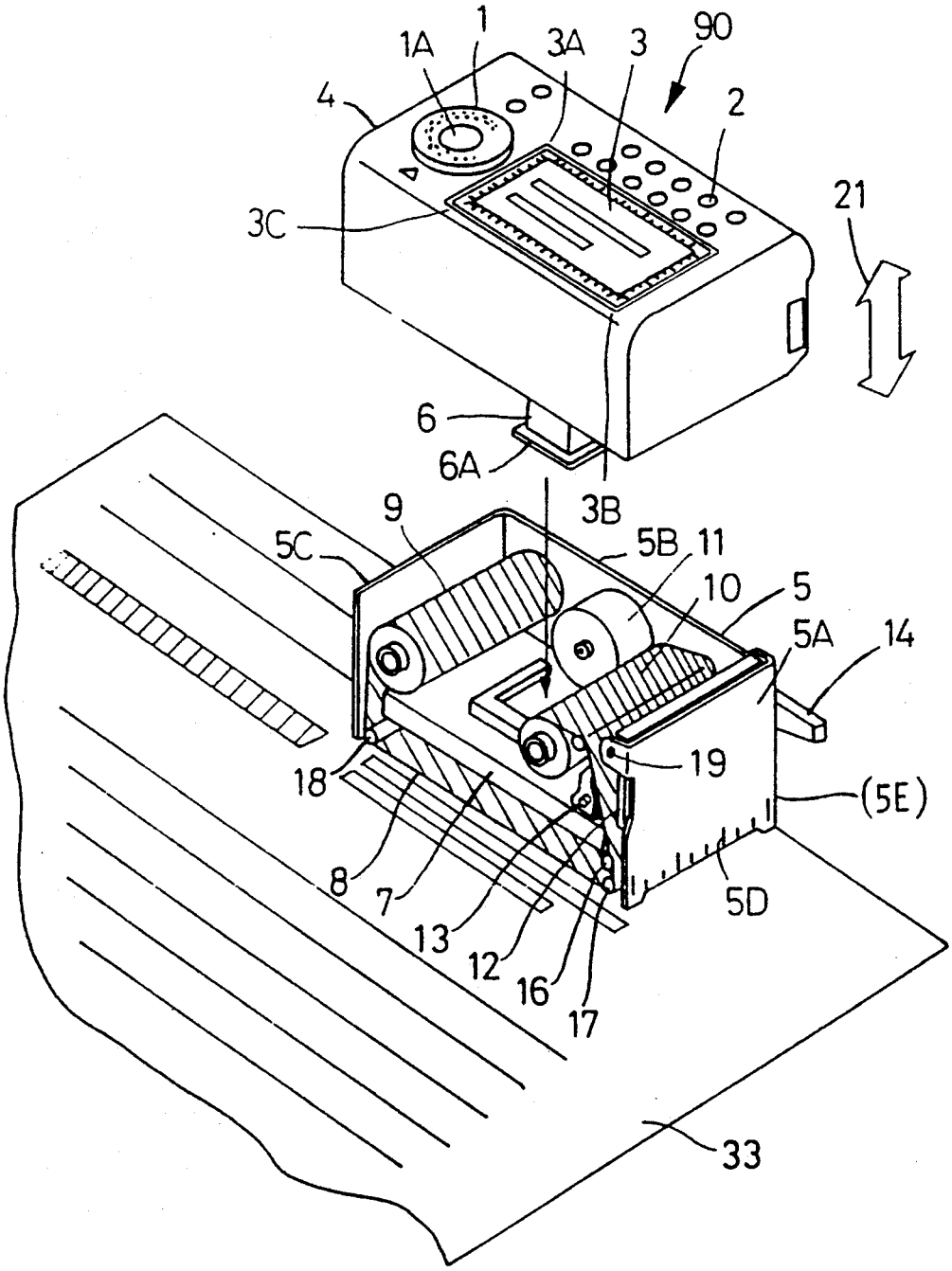
FIG. 7 is a perspective view of a stamp device according to a third embodiment of the present invention.
Figure 8:
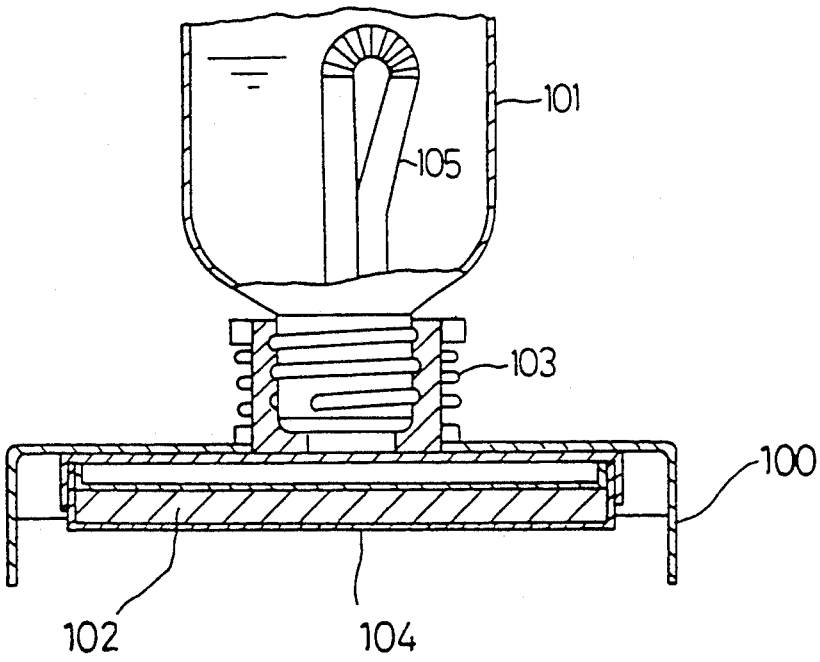
Fig.8 RELATED ART
FIG. 8 is a partial cross-sectional view of a conventional stamp device.

Next, a stamp device 90 according to a third embodiment of the present invention will be described with reference to FIG. 7. Because the construction of the stamp device 90 of the third embodiment is similar to that of stamp device 50 of the first embodiment, only the differences will be described in detail.

Graduated frame 3C is provided surrounding display 3 on housing 4 of stamp device 90. The graduated frame 3C is useful as described with respect to the second embodiment. Graduations 3D and 3E (the first graduations) are also formed in graduated frame 3C. An indicator 5D corresponding to graduation 3D, and an indicator 5E corresponding to graduation 3E are provided on the lower portion of chassis 5. (Indicator 5E is not directly shown because it is provided on the lower portion of the side wall 5B of chassis 5). The indicators 5D and 5E function as second graduations, and have a one-to-one correspondence with graduations 3D and 3E. As discussed above with respect to indicators 4B and 4C, each indicator 5D and 5E can have a one-to-one correspondence with a minimum character or symbol size to be printed on printing paper 33.

In stamp device 90 having the above-described construction, a shaded portion 3B displayed on display 3 when in the layout confirmation mode corresponds to the printing image position of printing paper 33 where the image is to be printed. Therefore, when the user executes the print operation, the user places stamp device 90 on printing paper 33 while corresponding the graduations 5D and 5E to the indicators 3D and 3E. As described above, because graduations 3D and 3E on graduated frame 3C of display 3 of stamp device 90 correspond to indicators 5D and 5E, respectively, the user can print accurately at any desired position in a manner similar to the print operation performed by the second embodiment.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the appended claims.

For example, in the described embodiments, to keep the price of the stamp device low, the resolution of the display is about 80 dots/inch, and the image displayed in the layout confirmation mode is displayed with this low resolution. However, the characters and symbols of the image could also be displayed by using a display means having a higher resolution.

Moreover, in the described embodiments, each indicator formed on the lower portion of the housing or the lower portion of the chassis, that is, in the vicinity of the printing side of the stamp device, preferably has a one-to-one correspondence with a minimum character or symbol size to be printed on the printing paper. However, it is not necessary for the indicators to have this one-to-one correspondence with a minimum character or symbol to be printed on the printing paper if the user can easily compare the indication formed in the vicinity of the display means with the minimum character or symbol size.

In addition, in the above-described second and third embodiments, the indicator is formed on the housing or on the chassis; however, the indicator can also be formed on both the housing and the chassis.

What is claimed is:

1. A stamp device comprising:

a stencil paper;

display means for displaying a desired image;

perforating means for perforating a perforation pattern corresponding to the desired image on said stencil paper;

a frame having a lower base which is capable of being disposed in face-to-face contact with a recording medium, said display means having a shape similar to a shape of said lower base so that dimensional ratios of said lower base and said display means are identical; and control means for controlling said display means so that said display means displays a layout of all of the characters of the desired image to be perforated on said stencil paper by said perforating means at one time.

2. The stamp device according to claim 1, wherein said display means has a size one-half as large as a size of said lower base.

3. The stamp device according to claim 1, further comprising:

a housing, wherein said display means is provided on said housing.

4. The stamp device according to claim 3, further comprising:

first graduations provided on said housing surrounding said display means.

5. The stamp device according to claim 4, further comprising;

a chassis movably attached to said housing, said chassis capable of being placed opposite to a recording medium, said housing being mounted on said chassis so as to move relative to said chassis in a vertical direction with respect to the recording medium when said chassis is placed on the recording medium; and second graduations provided on a lower portion of at least one of said housing and said chassis.

6. The stamp device according to claim 5, wherein said first graduations have a one-to-one correspondence with said second graduations.

7. The stamp device according to claim 5, wherein said stencil paper is a heat sensitive stencil paper.

8. The stamp device according to claim 7, wherein said heat sensitive stencil paper comprises:

a thermoplastic film;

an adhesive layer; and a porous carrier;

wherein said thermoplastic film and said porous carrier are bonded to each other through said adhesive layer.

9. The stamp device according to claim 8, further comprising:

ink storing means for storing ink, said ink storing means being provided on a side of said porous carrier of said heat sensitive stencil paper, said ink storing means being movable in the vertical direction according to a relative movement of said housing to said chassis.

10. The stamp device according to claim 1, wherein said stencil paper is a heat sensitive stencil paper.

11. A stamp device, comprising:

a stencil paper;
a housing;
input means provided on said housing for inputting a desired image and for editing a layout of the image;
first storing means for storing the image input by said input means and for storing the image edited by said input means;
display means provided on said housing for displaying the desired image;
perforating means for perforating a pattern corresponding to the desired image on said stencil paper;
first graduations provided on said housing surrounding said display means;
a chassis removably attached to said housing, said chassis capable of being placed opposite to a recording medium, said housing being mounted on said chassis so as to move relative to said chassis in a vertical direction with respect to the recording medium when said chassis is placed on the recording medium;
second graduations provided on at least one of said housing and said chassis; and
control means for controlling said display means so that the display means displays the layout for the desired image to be perforated on said stencil paper by said perforation means.

12. The stamp device according to claim 11, wherein said second graduations are provided on a lower portion of at least one of said housing and said chassis.

13. The stamp device according to claim 11, wherein said chassis includes a frame having a lower base which is capable of being disposed in face-to-face contact with the recording medium, wherein said display means has a shape similar to a shape of said lower base.

14. The stamp device according to claim 13, wherein said display means has a size one-half as large as a size of said lower base.

15. The stamp device according to claim 11, wherein said first graduations have a one-to-one correspondence with said second graduations.

16. The stamp device according to claim 11, wherein said stencil paper is a heat sensitive stencil paper comprising;
a thermoplastic film;
an adhesive layer; and
a porous carrier;
wherein said thermoplastic film and said porous carrier are bonded to each other through said adhesive layer.

17. The stamp device according to claim 16, further comprising:
ink storing means for storing ink, said ink storing means being provided at a side of said porous carrier of said heat sensitive stencil paper, said ink storing means being movable in a vertical direction according to a relative movement of said housing to said chassis.

18. A stamp device comprising:
a heat sensitive stencil paper;
a display;
a thermal head for perforating a perforation pattern corresponding to a desired image in the heat sensitive stencil paper;
a memory for storing the desired image;
a frame having a lower base which is capable of being disposed in face-to-face contact with a recording medium, said display having a shape similar to a shape of said lower base so that dimensional ratios of said lower base and said display means are identical;
control means for controlling said display to display a layout of the desired image to be perforated in said heat sensitive stencil paper by said perforating means so that the entire desired image is simultaneously displayed on said display for viewing by a user; and
an input device for editing the desired image stored in said memory.

19. The stamp device according to claim 18, further comprising:
a housing, said display being provided on said housing; and
first graduations provided on said housing surrounding said display.

20. The stamp device according to claim 19, further comprising:
a chassis movably attached to said housing, said chassis capable of being placed opposite to a recording medium, said housing being mounted on said chassis so as to move relative to said chassis in a vertical direction with respect to the recording medium when said chassis is placed on the recording medium; and
second graduations provided on a lower portion of at least one of said housing and said chassis.

* * * * *